US006857909B2

(12) United States Patent
Lee et al.

(10) Patent No.: US 6,857,909 B2
(45) Date of Patent: Feb. 22, 2005

(54) SYSTEM AND METHOD FOR A SEPARATE PROTECTIVE HOUSING OF A SIGNAL CONNECTOR COUPLING TO A PRINTED CIRCUIT BOARD

(75) Inventors: Jason J. Lee, Austin, TX (US); James D. Curlee, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/615,678

(22) Filed: Jul. 8, 2003

(65) Prior Publication Data

US 2005/0009403 A1 Jan. 13, 2005

(51) Int. Cl.[7] ..... H01R 25/00; H01R 27/02; H01R 31/00; H01R 33/88; H01R 12/00

(52) U.S. Cl. ..... 439/638; 439/55

(58) Field of Search ..... 439/629, 638, 439/55, 61, 218; 710/62

(56) References Cited

U.S. PATENT DOCUMENTS 5,289,342 A * 2/1994 Spalding et al. ..... 361/699
6,098,127 A * 8/2000 Kwang ..... 710/62
6,296,514 B1 * 10/2001 Medina et al. ..... 439/404
6,450,832 B1 * 9/2002 Aguilar et al. ..... 439/490
6,508,660 B2 1/2003 Self ..... 439/374
6,629,181 B1 * 9/2003 Alappat et al. ..... 710/300
2003/0003809 A1 1/2003 Maiers ..... 439/629
2003/0008565 A1 1/2003 Chang ..... 439/638

OTHER PUBLICATIONS

"High Speed Serialized AT Attachment," SerialATA Workgroup 2003 pp. 36–58.

* cited by examiner

*Primary Examiner*—Chandrika Prasad
(74) *Attorney, Agent, or Firm*—Hamilton & Terrile LLP; Robert W. Holland

(57) ABSTRACT

SMT Serial ATA signal connectors mounted to printed circuit boards are protected from excessive stress applied by a mating signal connector, such as during connection and disconnection of a mating signal connector cable or by forces applied to a connected cable, with a protective housing that fits as a separate piece to the mounted signal connector to align an opening that allows connection of the mating cable connector to the mounting tongue of the mounted signal connector. The inner surface walls of the protective housing absorb forces applied at the mating signal connector to reduce the risk of breakage of the mating tongue or of the mounting of the signal connector to the printed circuit board, such as mounting only by solder of the electrical connections or mounting with board locks.

19 Claims, 5 Drawing Sheets

SYSTEM AND METHOD FOR A SEPARATE PROTECTIVE HOUSING OF A SIGNAL CONNECTOR COUPLING TO A PRINTED CIRCUIT BOARD

BACKGROUND OF THE INVENTION

1. Field of the Invention

The present invention relates in general to the field of information handling system signal connector housings, and more particularly to a system and method for a printed circuit board host plug Serial ATA signal connector protective housing.

2. Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems typically include a number of components that communicate information between each other as electrical signals sent over buses. For example, the Serial ATA industry standard defines signals to transfer information between components, such as a hard disk drive and a central processing unit (CPU), over cables. One conventional configuration of processing components is to provide a separate interface card for supporting Serial ATA connections, such as through the PCI slot typically included in information handling systems. Alternatively, in order to eliminate the need for a separate interface card, Serial ATA connectors are placed directly on a printed circuit board (PCB), such as an information handling system's motherboard, with a right-angle mount using Surface-Mounted Technique (SMT). SMT typically secures the Serial ATA connector to the PCB with board locks coupled to the connector and soldered to the PCB. However, this mounting scheme uses additional equipment, such as placement nozzles, to ensure correct attachment of the connector to the PCB. The Serial ATA Specification does not define PCB mounting features.

One difficulty with direct mounting of a Serial ATA connector to a PCB is that the SMT board locks and electrical solder connections fail if excessive force is applied to the connector. For instance, insertion and removal forces applied to the connector from mating and unmating cables sometimes break the locks to allow separation of the connector from the PCB or fracture the solder to degrade or prevent signal transfers between the connector and the PCB. Vertical forces applied to the connector or to a cable secured to a connector increase the vulnerability to SMT secured connector failure both during assembly of the information handling system at initial manufacture or during addition of components after manufacture and shipment of an information handling system. As an example, an SMT Serial ATA connector secured with retention solder pads and not board locks tends to separate from a PCB with the application of as little as 2.3 lbs of force since the securing solder pads are constrained by the connector's size and available PCB surface area. If board locks are used to hold the connector to the PCB, separation of the connector from the PCB is less likely, however, a vertical force of approximately 3.8 lbs against a typical Serial ATA connector mating tongue will often result in failure of the mating tongue itself. When failure of an SMT Serial ATA connector occurs during manufacture, the typical fix is to replace the PCB, thus increasing the manufacturing costs due to scrap. When failure of an SMT Serial ATA connector occurs after manufacture, such as due to consumer addition of a Serial ATA peripheral, the complete information handling system may have to be replaced.

SUMMARY OF THE INVENTION

Therefore a need has arisen for a method and system which secures SMT attached connectors, such as SMT Serial ATA connectors, with enhanced strength to prevent separation or breaking of the connector.

A further need exists for a method and system which protects connector components secured to a PCB from fracturing due to the application of excessive force at the connector.

In accordance with the present invention, a method and system are provided which substantially reduce the disadvantages and problems associated with previous methods and systems for securing connectors mounted to a PCB. A protective housing fits over the signal connector proximate to the connection point of a mating signal connector to absorb forces applied at the mating signal connector that otherwise would translate to the mounted signal connector or its components, such as its mounting tongue.

More specifically, a protective housing formed with opposing openings accepts a mounted Serial ATA signal connector through one opening and a mating Serial ATA cable connector through the opposing opening with the inner walls of the protective housing engaging the signal connectors to absorb forces applied during connection or disconnection of the mating cable connector or forces applied through a connected cable. In one embodiment, the protective housing adds support to reinforce the mating tongue of the mounted Serial ATA signal connector by restricting movement of the cable connector relative to mounted connector. For instance, where the mounted Serial ATA signal connector is secured to a PCB with board locks, the protective housing reduces the risk of mating tongue breakage. In another embodiment, the protective housing adds support to reinforce the mounting of the signal connector to the PCB with key slots in which the PCB is inserted so that the protective housing engages the PCB separate from the signal connector mounting. The separate coupling of the protective housing to the PCB absorbs forces applied at the signal connector that otherwise would apply to the signal connector mounting. For instance, where the mounted Serial ATA signal connector is secured to a PCB with only the soldered electrical connections, the protective housing reduces the risk of soldered electrical connection breakage or fracturing. A snap lock coupled to the protective housing engages the mounted signal connector to hold the protective housing in position.

The present invention provides a number of important technical advantages. One example of an important technical advantage is that SMT attached Serial ATA connectors are provided with enhanced strength to help prevent separation or breaking of the connector. Serial ATA signal connectors offer relatively little surface area for mounting to a PCB, however, the protective housing enhances the mounting strength by absorbing forces applied at the signal connector. Serial ATA signal connectors mounted only with soldered electrical connections are provided extra strength to reduce the risk of fracturing or separation of the connector from the PCB by the key slots that separately engage the protective housing to the PCB and absorb forces otherwise leverage against the connectors. Serial ATA signal connectors secured by board locks have their mating tongues reinforced to reduce the risk of breaking by the inner surface walls of the protective housing which absorbs forces applied at a cable connector that otherwise would apply against the mating tongue.

Another example of an important technical advantage of the present invention is that components of a connector that is secured to a PCB are protected from fracturing or breaking due to the application of excessive force at the connector. A separate protective housing that fits over the connection point of a signal connector and mating cable provides enhanced strength for signal connector mountings to a PCB by translating vertical forces applied at the connector to the PCB. The translation of force from the signal connector to the PCB adds strength where relatively small signal connector surface area sizes reduce the available space for mounting the signal connector to the PCB. The restriction of movement of the cable connector by the inner surface of the protective housing reduces the leveraged forces applied by movement of the cable connector to relatively fragile signal connectors, such as mating tongues. The use of a separate add-on protective housing allows selective addition of reinforcing strength where needed due to connector size constraints or expected application of excessive force.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

Signal connectors mounted to information handling system printed circuit boards, such as Serial ATA signal connectors right-angle mounted with SMT, are strengthened against potential failures due to forces applied at the signal connector. A protective housing that couples to the signal connector and/or PCB as a separate support aligns an opening to allow coupling of the signal connector with a mating cable connector so that the inner surface of the opening absorbs forces applied at the mating cable connector coupling point to reduce the risk of breakage of the signal connector mounting to the PCB or of signal connector components, such mounting tongues. For purposes of this application, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
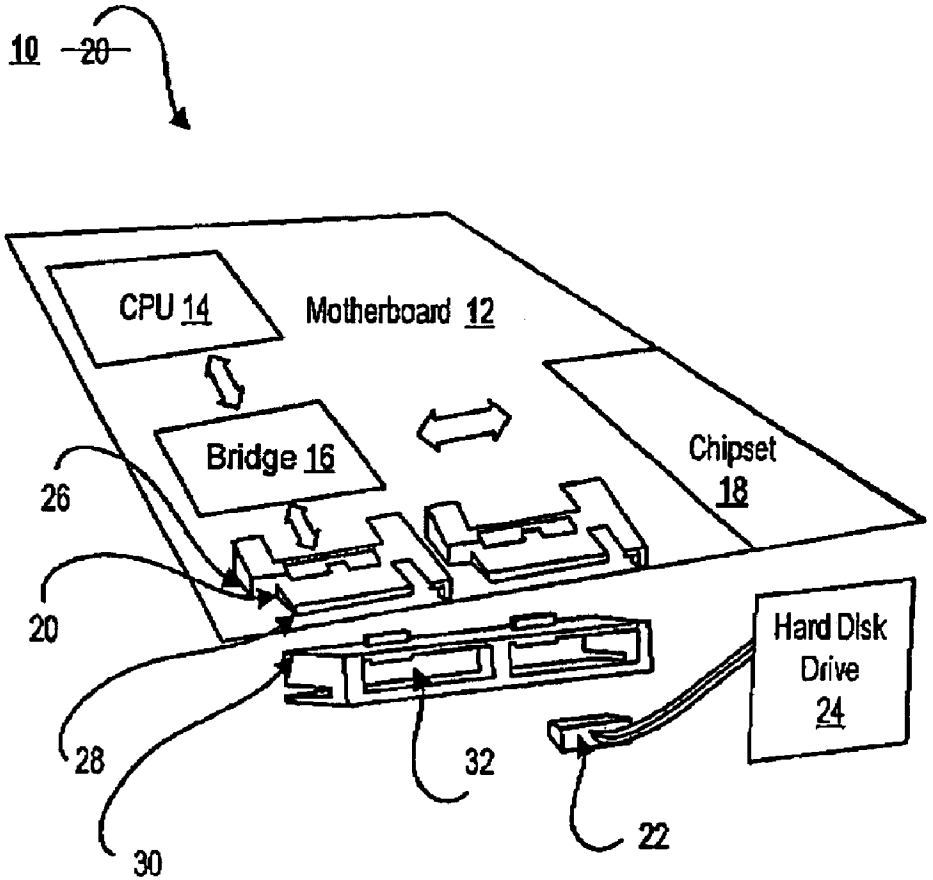
FIG. 1 depicts an information handling system having a protective housing aligned to insert on right-angle mounted signal connectors.

Referring now to FIG. 1, an information handling system 10 is depicted with a protective housing aligned to insert on dual adjacent SMT right-angle mounted signal connectors. Information handling system 10 has a motherboard 12 that supports information processing components, such as a CPU 14, bridge 16 and chipset 18, with wire lines disposed along motherboard 12 for communicating electronic signals between the processing components. First and second Serial ATA signal connectors 20 are mounted on motherboard 12 to communicate electronic signals received through a mated cable Serial ATA connector cable 22 from a hard disk drive 24 to processing components such as CPU 14. Each Serial ATA signal connector 20 is mounted to motherboard 12 with board locks 26 and soldered electrical connections between the signal wires of connector 20 and the wire lines of motherboard 12. A mating tongue 28 extends from each Serial ATA connector 20 to seat in a corresponding receptacle of mating cable connector 22.

The mounted Serial ATA signal connector standing alone is vulnerable to failure if excessive force is applied, especially force aligned perpendicular to motherboard 12, such as forces generated during connection and disconnection of mating cable connector 22 and forces applied by an attached cable connector 22. In order to reinforce the mounting of Serial ATA connectors 20, a protective housing 30 inserts mounted connectors 20 into openings 32 which allow coupling of mating cable connector 22 in the restricted space defined by the inner walls of opening 32. Once mating cable connector 22 enters opening 32, the inner walls restrict movement of cable connector 22 relative to mounted connector 20 so that forces applied by cable connector 22 that would otherwise work on mounted connector 20 are instead translated to and absorbed by protective housing 30. Thus, protective housing 30 reduces the risk of breakage of mounting tongue 28 by an inadvertent application of force from mating cable connector 22. Further, protective housing 30 couples to motherboard 12 by a coupling device separate from that of mounted connector 20 to reduce the risk that excessive force applied to mounted connector 20 by cable connector 22 will separate mounted connector from motherboard 12 or will fracture the soldered electrical connections of mounted connector 20.

Figure 2B:
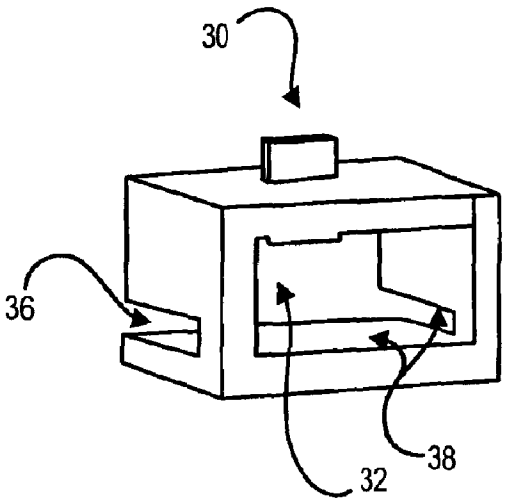
FIG. 2B depicts a perspective view of a protective housing configured to fit over a single SMT Serial ATA signal connector.
Figure 2A:
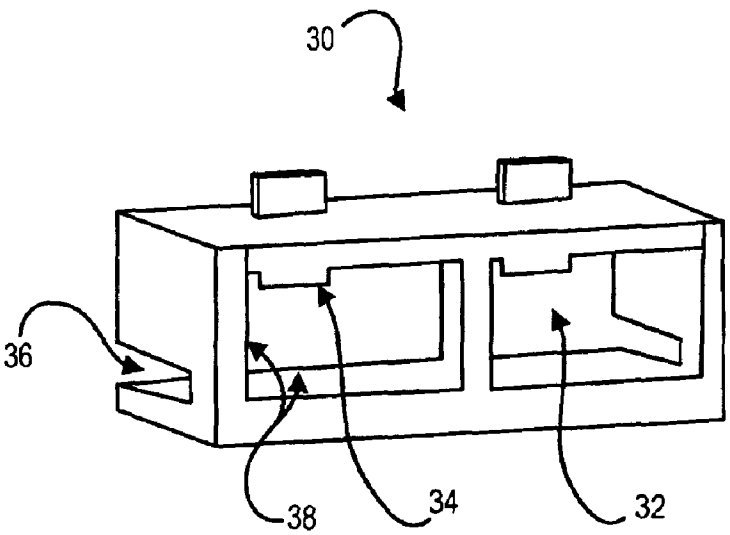
FIG. 2A depicts a perspective view of a protective housing configured to fit over dual adjacent SMT Serial ATA signal connectors.

Referring now to FIGS. 2A and 2B, side perspective views of protective housings 30 are depicted, with FIG. 2A depicting a protective housing 30 for dual adjacent mounted signal connectors and FIG. 2B depicting a protective housing 30 for a single mounted signal connector. Each protective housing 30 has a snap fit latch 34 made of a flexible material to engage the rear of the mounted signal connector when the mounted signal connector is inserted in opening 32. Opposing parallel key slots 36 accept a PCB and engage protective housing 30 to the PCB with an attachment separate from the mounting of the signal connector to the PCB with soldered electrical connections or board locks. The inner walls 38 of opening 32 are sized to snuggly accept signal connectors inserted through opposing ends of opening 32 so that force applied to a connector translates to and is absorbed by protective housing 30.

Figure 3:
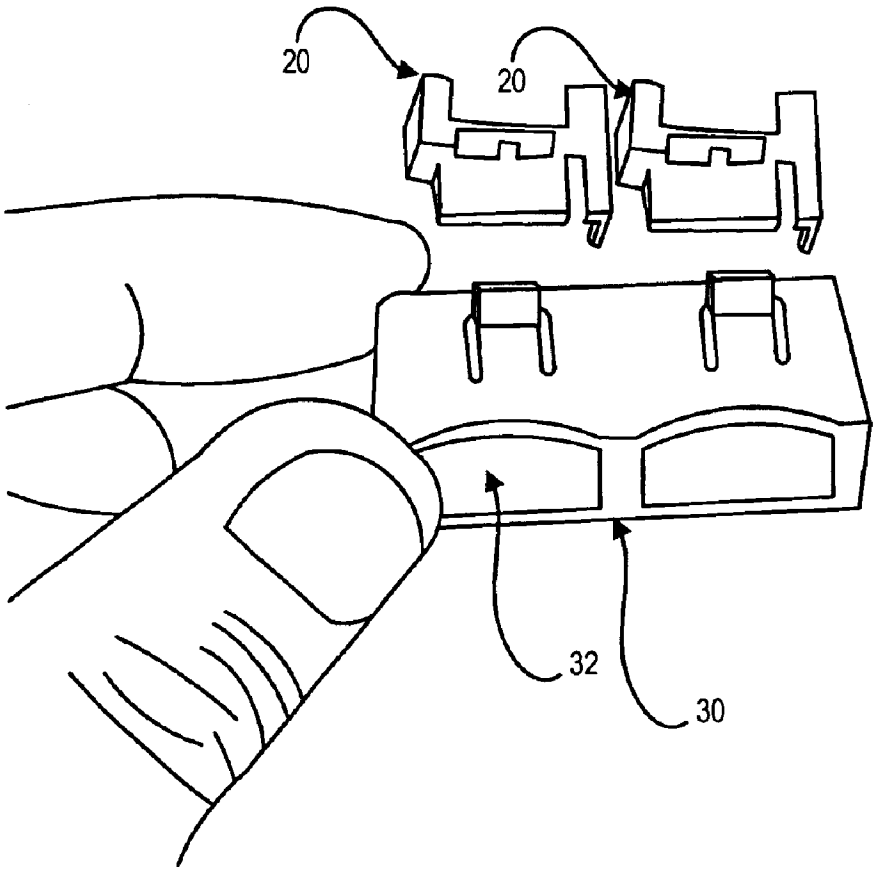
FIG. 3 depicts a protective housing being inserted over dual adjacent SMT Serial ATA signal connectors.
Figure 4:
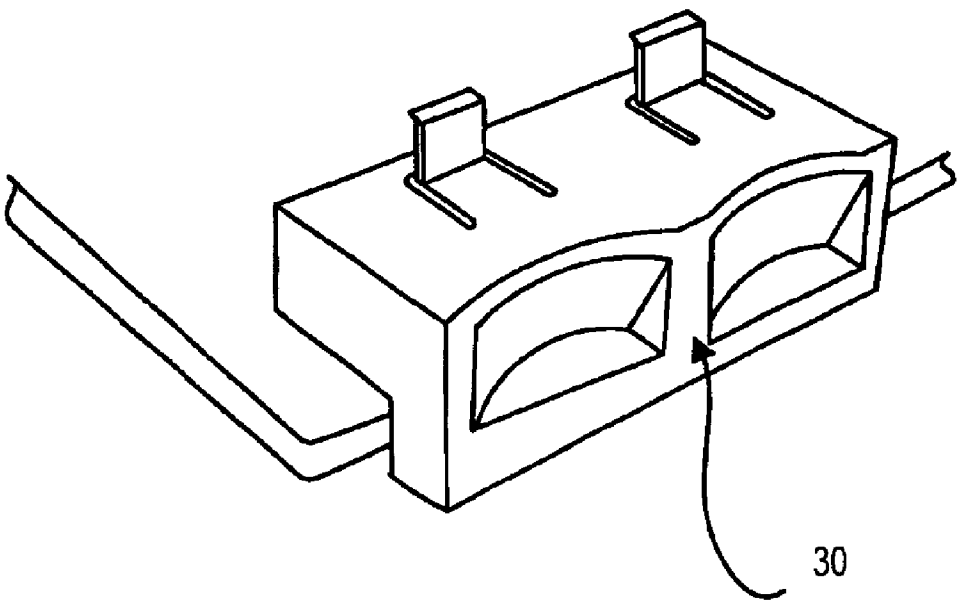
FIG. 4 depicts a protective housing coupled to a PCB over dual adjacent SMT Serial ATA signal connectors.
Figure 5:
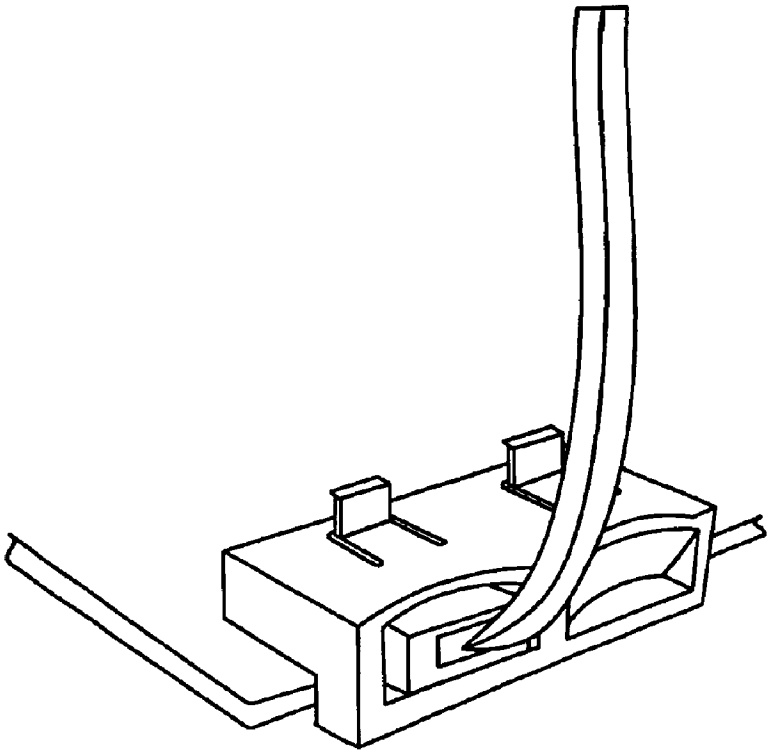
FIG. 5 depicts a Serial ATA mating cable connector coupled to a Serial ATA signal connector through a protective housing opening.

Referring now to FIGS. 3 and 4, side perspective views depict a dual adjacent protective housing 30 fitting over dual adjacent right-angle mounted Serial ATA signal connectors 20. Mounted connectors 20 insert into one end of opening 32 to house mating tongue 28 aligned with the opposing end of opening 32 for insertion of a cable connector. As protective housing 30 fits over mounted connectors 20, slots 36 engage the PCB of motherboard 12 and, when protective housing 30 is fully inserted, snap fit latch 34 engages the rear of mounted connector 20 to lock protective housing 30 in place. As depicted by FIG. 4, an installed protective housing 30 engages motherboard 12 separate from the mounting of mounted connector 20 so that inadvertent forces that otherwise would have applied against mounted connector 20 are instead absorbed by the coupling of protective housing 30. For instance, as depicted in FIG. 5, a cable connector installed within protective housing 30 to communicate with mounted connector 20 is restricted from translating force in the axis perpendicular to the plane of motherboard 12, such as if the cable is pulled upon. In alternative embodiments, protective housing 30 does not have separate coupling to motherboard 12 and instead protects mating tongue 28 by restricting translation of force between a mounted and cable connector without restricting translation of force relative to motherboard 12.

Although the present invention has been described in detail, it should be understood that various changes, substitutions and alterations can be made hereto without departing from the spirit and scope of the invention as defined by the appended claims.

What is claimed is:

1. An information handling system comprising:

a printed circuit board operable to support and interface information processing components;

plural information processing components, the information processing components disposed on the printed circuit board and at least one information processing component disposed distal the printed circuit board;

a cable extending from the distal information processing component and ending at a cable signal connector, the cable and signal connector operable to communicate information with the distal processing component;

a board signal connector mounted on the printed circuit board and coupled with the cable signal connector to communicate signals between the printed circuit board and the distal processing component; and a protective housing coupled to the printed circuit board proximate to and separate from the board signal connector and the cable connector, the protective housing having an opening aligned to allow coupling of the cable and board signal connector, the opening having walls disposed proximate the signal connectors to absorb force applied at the signal connectors.

2. The information handling system of claim 1 further comprising a second board signal connector mounted on the circuit board proximate the first board signal connector and wherein the protective housing further has a second opening aligned to allow coupling of a second cable signal connector to the second board signal connector, the second opening having walls disposed proximate the cable signal connector to absorb force applied at the second cable signal connector.

3. The information handling system of claim 1 wherein the board signal connector comprises a Serial ATA connector.

4. The information handling system of claim 3 wherein the Serial ATA connector is coupled to the printed circuit board by solder electrical connections.

5. The information handling system of claim 3 wherein the Serial ATA connector is coupled to the printed circuit board by board locks.

6. The information handling system of claim 1 wherein the protective housing couples to the printed circuit board with parallel slots formed in the protective housing, the parallel slots accepting insertion of the printed circuit board.

7. The information handling system of claim 6 further comprising a snap lock extending from the protective and aligned to engage the board connector after insertion of the printed circuit board into the parallel slots.

8. A method for securing a signal connector to a printed circuit board, the method comprising:

mounting the signal connector to the printed circuit board so that a mating connector inserts into the signal connector substantially at a right angle to the printed circuit board;

aligning a protective housing with the signal connector so that the signal connector inserts through an opening of the protective housing, the signal connector separate from the housing connector, coupling the protective housing to the printed circuit board;

absorbing force applied at the signal connector with the protective housing;

inserting a mating connector into the signal connector, the mating connector separate from the protective housing; and supporting the mating connector outer surface with the inner surface of the protective housing opening.

9. The method of claim 8 wherein mounting the signal connector is soldering electrical connections of the signal connector to the printed circuit board.

10. The method of claim 8 wherein mounting the signal connector further comprises mounting the signal connector to the printed circuit board with board locks.

11. The method of claim 10 wherein the signal connector comprises a Serial ATA signal connector having a mating tongue extending parallel to the printed circuit board, the protective housing absorbing force applied to the mating tongue perpendicular to the printed circuit board.

12. The method of claim 8 wherein coupling the protective housing to the printed circuit board further comprises:

inserting the printed circuit board into slots of the protective housing so that force applied to the protective housing is absorbed at the printed circuit board; and locking the protective housing to the signal connector.

13. The method of claim 12 wherein the signal connector comprises a Serial ATA signal connector having a mating tongue that inserts into a mating connector, the protective housing absorbing force applied by the mating connector to the signal connector.

14. A system for protecting a Serial ATA connector having a mounting tongue and a right-angle mount to a printed circuit board, the system comprising:

a Serial ATA connector adapted to right-angle mount to a printed circuit board; and a housing separate from the Serial ATA connector and having openings on opposing sides, the openings sized to accept the Serial ATA connector from one side and a separate Serial ATA mated cable connector from the opposing side, the openings having an inner surface proximate the mated cable connector that restricts movement of the mated cable connector relative to the mounting tongue.

15. The system of claim 14 wherein the housing further comprises first and second adjacent sets of opposing openings, each set of opposing openings sized to accept a Serial ATA connector from one side and a Serial ATA mated cable connector from the opposing side.

16. The system of claim 14 wherein the Serial ATA connector is mounted to the printed circuit board with soldered electrical attachments, the housing further comprising opposing key slots aligned to engage the printed circuit board to absorb force applied to the soldered electrical attachments.

17. The system of claim 14 wherein the Serial ATA connector mounted to the printed circuit board with board locks.

18. The system of claim 14 further comprising a snap lock integrated with the housing and operable to engage the Serial ATA connector to restrict movement of the housing relative to the Serial ATA connector.

19. The system of claim 18 further comprising a mated cable connector operable to insert in the Serial ATA connector to communicate information from the printed circuit board to a hard disk drive.

* * * * *